US007257908B2

(12) United States Patent
Valat et al.

(10) Patent No.: US 7,257,908 B2
(45) Date of Patent: Aug. 21, 2007

(54) BOOT HAVING A FLOATING ARTICULATION

(75) Inventors: Gerard Valat, Aix-en-Provence (FR); Cedric Ragot, Paris (FR)

(73) Assignee: Random Design, Aix-en-Provence (FR)

( * ) Notice: Subject to any disclaimer, the term of this patent is extended or adjusted under 35 U.S.C. 154(b) by 210 days.

(21) Appl. No.: 10/518,631

(22) PCT Filed: Jun. 17, 2003

(86) PCT No.: PCT/FR03/01838

§ 371 (c)(1),
(2), (4) Date: Dec. 20, 2004

(87) PCT Pub. No.: WO04/000057

PCT Pub. Date: Dec. 31, 2003

(65) Prior Publication Data

US 2005/0217151 A1 Oct. 6, 2005

(30) Foreign Application Priority Data

Jun. 20, 2002 (FR) ..... 02 07636

(51) Int. Cl.
*A43B 5/04* (2006.01)

(52) U.S. Cl. ..... 36/131; 36/117.5; 36/118.2

(58) Field of Classification Search ..... 36/131, 36/117.5, 118.2
See application file for complete search history.

(56) References Cited

U.S. PATENT DOCUMENTS 3,067,531 A * 12/1962 Scott et al. ..... 36/118.2
3,303,584 A * 2/1967 Werner et al. ..... 36/118.7
3,732,635 A * 5/1973 Marker ..... 36/117.5
3,945,134 A * 3/1976 Ramer ..... 36/117.2
4,546,558 A * 10/1985 Perini ..... 36/117.5
4,563,825 A * 1/1986 Tesser ..... 36/131
5,675,917 A * 10/1997 Falguere et al. ..... 36/117.2

FOREIGN PATENT DOCUMENTS

| | | |
|---|---|---|
| EP | 0 813 825 | 12/1997 |
| WO | WO 01 35781 | 5/2001 |
| WO | WO 01 89335 | 11/2001 |

* cited by examiner

*Primary Examiner*—Ted Kavanaugh
(74) *Attorney, Agent, or Firm*—Young & Thompson

(57) ABSTRACT

An item of footwear is intended for sports practice and is used to protect the feet and legs of a user. The footwear includes: a first rigid shell defining a body (2) which is designed to receive the foot of the user and which extends in a horizontal direction (8); a second rigid shell defining a shaft (4) which is designed to receive the leg of the user and which extends essentially along a vertical axis (10); and a connection (6) which joins the body and the shaft and which is used to rotate the shaft in relation to the body along two essentially-perpendicular rotation axes (8, 12) and to move the axes of the connections in relation to the body, such that the axes of rotation of the aforementioned connection essentially coincide with the axes of rotation of the foot in relation to the leg of the user.

19 Claims, 2 Drawing Sheets

BOOT HAVING A FLOATING ARTICULATION

Figure 4:
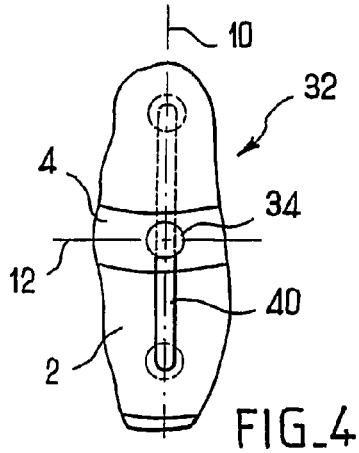

This application is a 371 of PCT/FR03/01838 filed on Jun. 17, 2003.

The present invention relates to an item of footwear intended for sporting use. It is intended to protect the feet and legs of a user.

It is particularly suitable for use in motor sports and, more particularly, off-road motorcycling, where the feet and legs of the user are very exposed. However, it can also be found to be advantageous for motorcycling, snowboarding, mountain biking, jet-skiing or hiking, in particular.

There are already known motocross boots having a leather upper, to which reinforcements of plastics material are fixed. The reinforcements provide protection, whilst the leather brings about the connection between the reinforcements and allows a degree of flexibility. Boots of this type are hardly satisfactory in that the protection is limited and the freedom of movement reduced.

On the other hand, WO-A-01 35781 discloses a boot comprising:

- a first rigid shell which defines a body which is intended to receive the foot of a user and which extends in an extension direction,
- a second rigid shell which defines an upper which is intended to receive the leg of the user and which extends substantially in an upright direction and
- an articulation which connects the body and the upper, said articulation allowing the upper to rotate relative to the body in two axes of rotation which are substantially perpendicular to each other.

However, although that boot having great mechanical strength provides satisfactory protection for the user and a high level of precision in guiding movements owing to its design having spherical caps, it provides only average comfort during use.

In order to overcome this disadvantage and to simplify the construction of the boot, without diminishing the protection for the user, the invention proposes that said articulation further allows translation of the axes of articulation relative to the body in order to bring the axes of rotation of the articulation substantially into alignment with the axes of rotation of the foot relative to the leg of the user.

Thus, the boot adapts to the morphology of the user, provides greater mobility and a sensation of greater flexibility, whilst more faithfully following the complex nature of the movement of the ankle.

Advantageously, the articulation comprises at least a resiliently deformable element which tends to move the item of footwear into an initial position.

In this manner, the user perceives that his movements are being progressively assisted and has a very clear sensation of being assisted.

According to another advantageous feature of the invention, the articulation comprises two resiliently deformable elements which are arranged symmetrically relative to the upright direction and which have different mechanical features.

Thus, the features of resistance to deformation can be more precisely adapted to the requirements for protecting the user, in particular owing to the imperfect symmetry of the ball and socket joint between the foot and the leg.

Advantageously, each resiliently deformable element comprises at least a flexible strip having an inwardly curved shape in the absence of any external stress. The effort in terms of flexion of the strip allows the rotation and translation movements between the body and the upper to be controlled effectively and simultaneously.

A simple and strong articulation having the above-mentioned features consists in that each resiliently deformable element comprises two substantially flexible strips which are V-shaped or U-shaped so that each flexible strip comprises two branches, each comprising a first end and a second end, the first ends of each flexible strip being connected to each other and the second ends of each flexible strip being connected, in the case of one of the branches, to the body and, in the case of the other branch, to the upper.

According to a supplementary advantageous feature, the item of footwear further comprises a resiliently deformable material which is different from that of the branches and which extends between the branches of at least some of the flexible strips.

Thus, the deformation of the flexible strips is damped and is readily adjustable by the properties of the resiliently deformable material being modified. Furthermore, this prevents an undesirable element (pebbles, mud, sand . . . ) from becoming introduced between the branches of the flexible strips and then modifying the mechanical properties of the resiliently deformable element.

In order to supplement the protection for the user, in accordance with another advantageous feature, with the upright direction and the extension direction defining a centre plane, the item of footwear further comprises stops for limiting the extent of rotation in the centre plane to a value of between 50° and 60°.

This prevents traumatisms or injuries whilst allowing great freedom of movement.

According to another feature, the invention proposes that the item of footwear further comprises stops for limiting the extent of rotation in the extension direction to a value of between 25° and 35°.

In accordance with another advantageous feature of the invention, said articulation further allows translation only in the upright direction.

The translation movement of the axes of articulation relative to the body, although it is only small in extent, advantageously being between 5 millimeters and 15 millimeters, nevertheless provides a sensation of freedom of movement, whilst effectively holding the ankle of the user.

Figure 1:
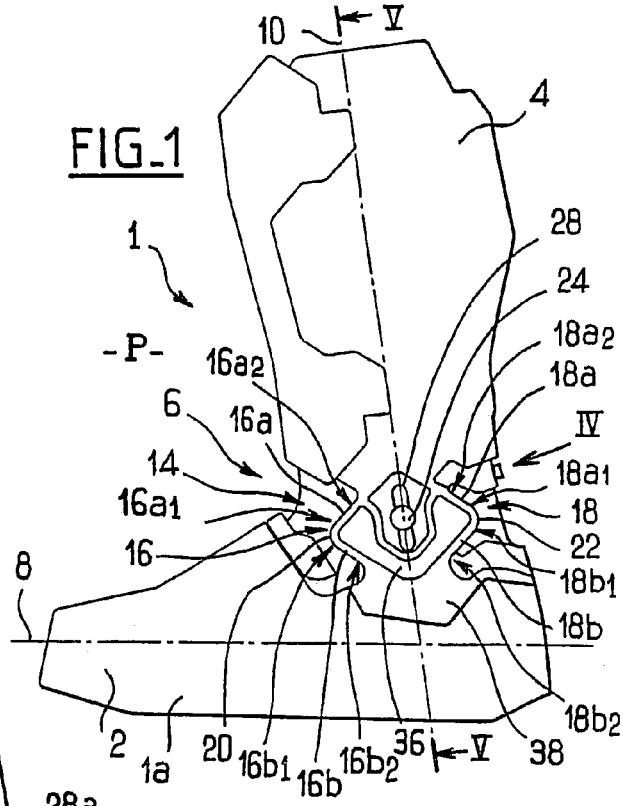
Figure 2:
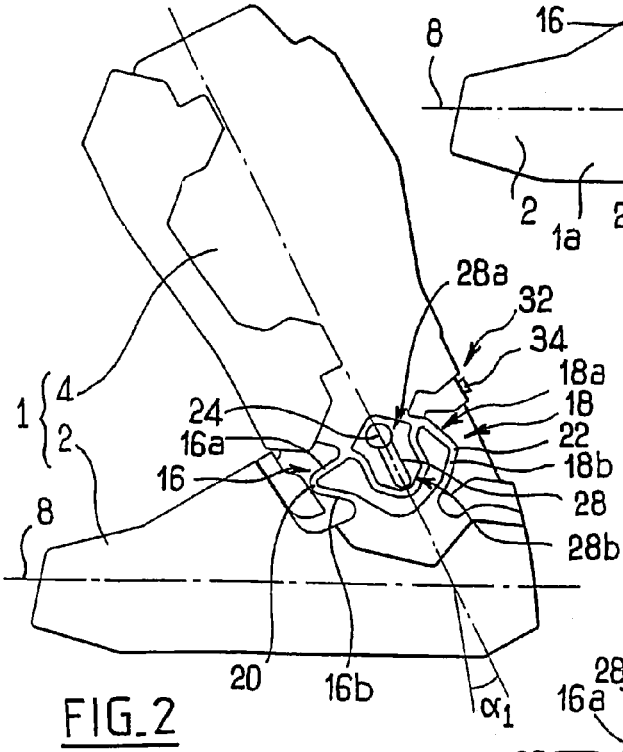
Figure 3:
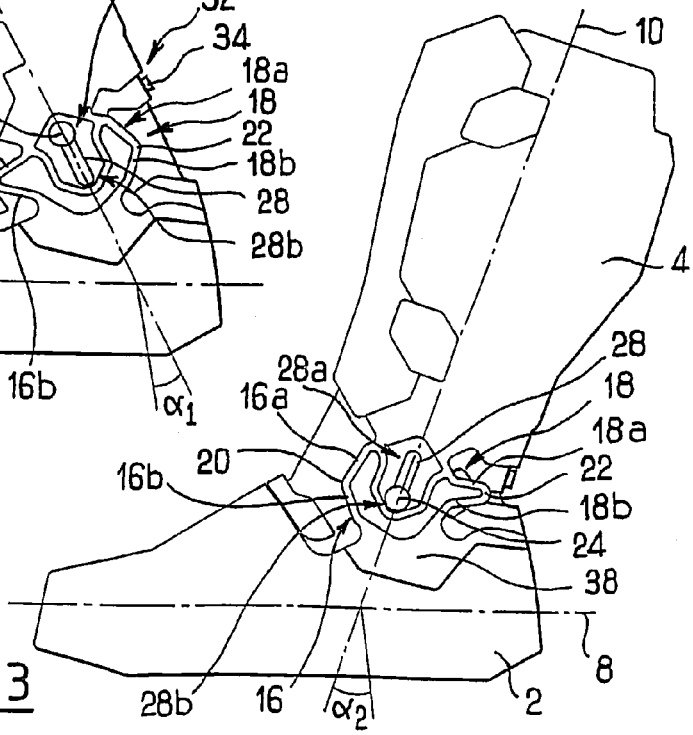
Figure 7:
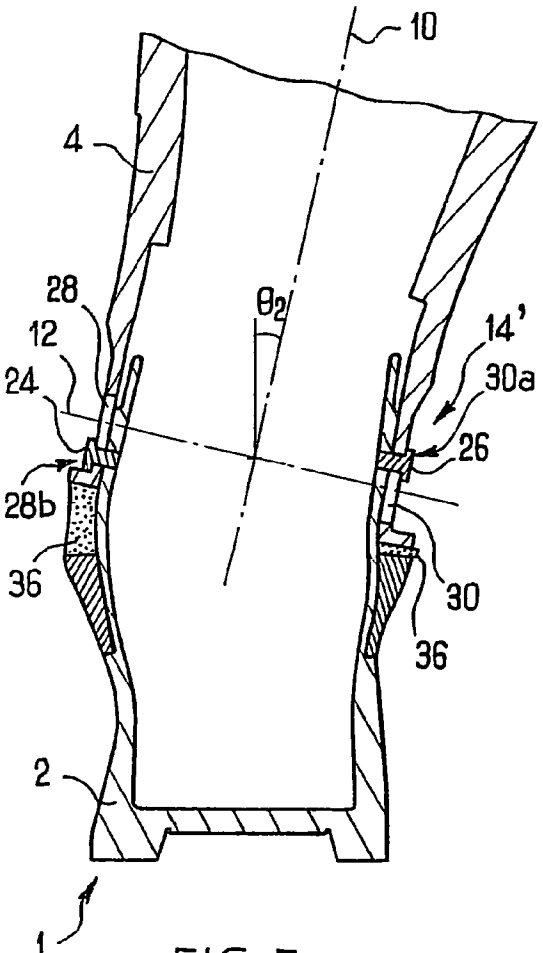
Figure 6:
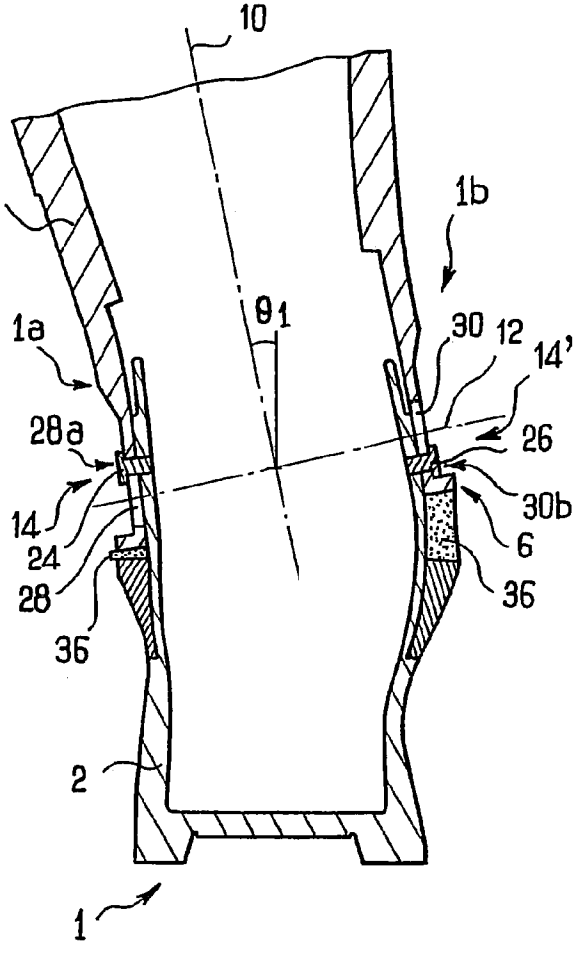
Figure 5:
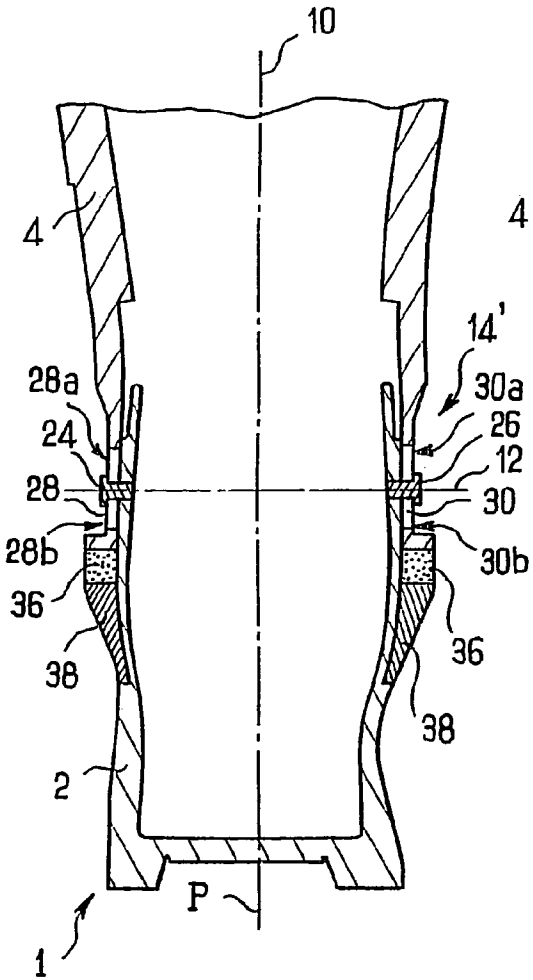

The invention will be appreciated even more clearly from the description below given with reference to the appended drawings, in which:

FIG. 1 illustrates a motorcycle boot according to the invention in a rest position, FIG. 2 illustrates the boot of FIG. 1 in a flexion position, FIG. 3 illustrates the boot of FIG. 1 in an extension position, FIG. 4 is a view according to the arrow indicated IV in FIG. 1, FIG. 5 is a view sectioned according to the arrow indicated V-V in FIG. 1, in a rest position, FIG. 6 is a view in accordance with FIG. 5, with the boot in the pronation position, FIG. 7 is a view in accordance with FIG. 5, with the boot in the supination position.

The Figures illustrate a boot 1 comprising, in the lower portion, a body 2 which is intended to receive the foot of a user, in the upper portion, an upper 4 which is intended to receive the leg of a user and, in the intermediate portion, an articulation device 6 which connects the upper 4 to the body 2.

The body 2 and the upper 4 each comprise a relatively rigid shell which is intended to protect the lower limbs of the user. These shells can be perforated locally. They are lined internally for the comfort of the user, and optionally externally. The body extends in an extension direction 8 which is substantially horizontal when the user places his foot on a horizontal surface, whilst the upper extends in an upright direction 10 which is substantially vertical.

The extension direction 8 and the upright direction 10 define a centre plane P which is parallel with the plane of illustration of FIGS. 1 to 3. The boot has an inner face 1*a* and an outer face 1*b*, which are arranged at one side and the other of the centre plane P.

The boot 1 further has a transverse direction 12 which extends substantially perpendicularly to the extension direction 8 and the upright direction 10.

The articulation device comprises two structures 14, 14' which have resiliently deformable geometry and which are arranged substantially symmetrically relative to plane P, one at the inner face 1*a* and the other at the outer face 1*b*.

Each structure 14, 14' mainly comprises a flexible front strip 16 and a flexible rear strip 18 (the flexible strips of the structure 14' are not visible in the Figures), each being curved inwards substantially in the shape of a V-shaped or U-shaped rib. Each flexible strip comprises an upper branch 16*a*, 18*a* and a lower branch 16*b*, 18*b*. Each branch 16*a*, 16*b*, 18*a*, 18*b* extends between a first end $\mathbf{16}a_1$, $\mathbf{16}b_1$, $\mathbf{18}a_1$, $\mathbf{18}b_1$ and a second end $\mathbf{16}a_2$, $\mathbf{16}b_2$, $\mathbf{18}a_2$, $\mathbf{18}b_2$, respectively.

The first ends $\mathbf{16}a_1$, $\mathbf{16}b_1$ of the branches of the flexible front strip 16 are connected to each other in a front apex zone 20 which allows rotation between the upper branch 16*a* and lower branch 16*b*. The first ends $\mathbf{18}a_1$, $\mathbf{18}b_1$ of the branches of the flexible rear strip 18 are connected to each other in a rear apex zone 22 which allows rotation between the upper branch 18*a* and lower branch 18*b*.

The two ends $\mathbf{16}b_2$, $\mathbf{18}b_2$ of the lower branches are fixed to the body 2, and the two ends $\mathbf{16}a_2$, $\mathbf{18}a_2$ of the upper branches are fixed to the upper 4.

The flexible front strip 16 and flexible rear strip 18 are rather in the shape of an open V, as illustrated, when the apex zones 20, 22 are very close together, or rather in the shape of an open U when these zones 20, 22 are relatively stretched out.

They are advantageously arranged opposite each other, in other words symmetrically relative to the direction of upright 10. Here, they are open relative to each other so that each structure 14 is substantially in the form of a deformable parallelogram. Alternatively, they could be arranged back to back so that each structure 14 substantially has a deformable "><" shape.

They have a modulus in flexure depending on the sport practised and the physical strength of the user.

The articulation device 6 further comprises two pivots 24, 26 which extend substantially in the transverse direction between the flexible front strip 16 and rear strip 18. They are fixed to the body 2 and each slide in a groove 28, 30 which is provided in the upper 4. The grooves 28, 30 are each of rectangular form extending substantially in the direction of upright 10 between an upper end 28*a*, 30*a* and a lower end 28*b*, 30*b* that is advantageously located approximately 10 millimeters away.

Thus, the pivots 24, 26 control the deformation of the structures 14, 14' and can move in the upright direction so that the structures 14, 14' having a variable geometry thus define a floating articulation device which is positioned substantially at the level of the malleolus at both sides of the ankle of a user.

As illustrated in FIGS. 1 and 2, in the case of a flexion movement of the ankle of a user about the transverse direction 12, the upper 4 pivots about the pivots 24, 26, the branches 16*a*, 16*b* of the front flexible strips 16 move together by means of deformation of the front apex zones 20, whilst the branches 18*a*, 18*b* of the rear flexible strips 18 move apart by means of deformation of the rear apex zones 22.

As illustrated in FIGS. 1 and 3, the articulation device 6 is deformed in the opposite manner during an extension movement, the front flexible strips 16 moving apart and the rear flexible strips 18 moving together.

During those flexion and extension movements, the upper branches 16*a*, 18*a* further pivot relative to the upper 4 by means of resilient deformation in the region of the second end $\mathbf{16}a_2$, $\mathbf{18}a_2$ thereof, and the lower branches 16*b*, 18*b* likewise pivot relative to the body 2 by means of resilient deformation in the region of the second end $\mathbf{16}b_2$, $\mathbf{18}b_2$ thereof.

Since the pivots 24, 26 can slide in the grooves 28, 30, in an extreme flexion position, the upper 4 moves into abutment at the front against the body 2 and the pivots 24, 26 move near the upper end 28*a*, 30*a* of the grooves 28, 30 in order to follow the movement of the malleolus of the user. If the flexion movement were to be continued, the pivots 24, 26 would tend to slide in the grooves 28, 30 towards the lower end thereof. Since such a movement may injure the user, the boot 1 further comprises a rear stop device 32.

As illustrated in FIG. 4, this rear stop device 32 which is intended to limit the flexion movement comprises a stud having an enlarged head 34 which is fixedly joined to the body 2 and which slides in a rectangular groove 40 provided in the upper 4. The extreme positions of the stud having an enlarged head 34 corresponding to maximum flexion and extension are illustrated as a dot-dash line in FIG. 4.

As indicated in FIG. 2, the extent $\alpha_1$ of the flexion movement allowed by the articulation device 6 is approximately 25° relative to the initial position illustrated in FIG. 1.

In an extreme extension position, the upper 4 moves into abutment at the rear against the body 2 and the pivots 24, 26 move into abutment at the lower end 28*b*, 30*b* of the grooves 28, 30.

As indicated in FIG. 3, the extent $\alpha_2$ of the extension movement allowed by the articulation device 6 is approximately 30° relative to the initial position illustrated in FIG. 1.

The structures 14, 14' further allow, owing to the parallelogram-like geometry thereof, lateral deformation in a direction substantially parallel with the extension direction 8 in order to accompany the foot of the user during its pronation and supination movements and combined torsion movements.

As illustrated in FIGS. 5 and 6, during a pronation movement of the ankle of a user, the upper branches 16*a*, 18*a* move, by means of deformation of the front apex zones 20 and rear apex zones 22, towards the lower branches 16*b*, 18*b*. The pivot 24 further moves towards the upper end 28*a* of the groove 28.

Conversely, with regard to the structure 14', the upper branches move away from the lower branches by means of deformation of the front and rear apex zones. Furthermore, the pivot 26 moves towards the lower end 26*b* of the groove 26.

In the extreme pronation position of the boot, the pivot 24 moves into abutment against the upper end 28*a* of the groove 28 and the pivot 26 moves into abutment against the lower end 26*b* of the groove 26. The extent of the pronation movement $\theta_1$ allowed by the articulation device 6 relative to the initial position illustrated in FIG. 5 is approximately 15°.

As illustrated in FIGS. 5 and 7, in a converse manner during a supination movement of the ankle of a user, the upper branches 16*a*, 18*a* move away from the lower branches 16*b*, 18*b* by means of deformation of the front apex zones 20 and rear apex zones 22. Furthermore, the pivot 24 moves towards the lower end 28*b* of the groove 28.

With regard to the structure 14', the upper branches move towards the lower branches by means of deformation of the front and rear apex zones. Furthermore, the pivot 26 moves towards the upper end 26*a* of the groove 26.

In the extreme supination position of the boot, the pivot 24 moves into abutment against the lower end 28*b* of the groove 28 and the pivot 26 moves into abutment against the upper end 26*a* of the groove 26. The extent of the supination movement $\theta_2$ allowed by the articulation device 6 relative to the initial position illustrated in FIG. 5 is approximately 15°.

The articulation device 6 further comprises a shock-absorbent material 36 which is resiliently deformable and which is different from that constituting the flexible strips 16, 18. This shock-absorbent material 36 is arranged between the flexible strips 16, 18 and fills the space which separates the branches 16*a*, 16*b*; 18*a*, 18*b* of the flexible strips.

When the structures 14, 14' are deformed relative to the initial position, the shock-absorbent material 36 is extended or compressed. In that manner, it applies an increasing resisting effort which allows shocks to be prevented or at least reduced when the articulation device moves into abutment.

Advantageously, the shock-absorbent material 36 attached to the structure 14, that is to say, arranged at the inner face 1*a*, and that attached to the structure 14', that is to say, arranged at the outer face 1*b*, are different in order to produce asymmetric behaviour of the articulation device 6. Similarly, the structures 14, 14' can have different mechanical properties, as indicated above.

The material of the structures 14, 14' having resiliently deformable geometry is advantageously constituted by technical polymers, such as polyamides or polyurethanes. The shock-absorbent material advantageously has inferior properties of mechanical strength. In particular, it can be constituted by polyurethane foam.

As illustrated, the structures 14, 14' are produced by moulding in a single piece with the upper, as well as an intermediate portion 38 connected to the second end 16$b_2$, 18$b_2$ of the lower branches 16*b*, 18*b*. This intermediate portion 38 is subsequently fixedly joined to the body 2.

The invention claimed is:

1. Item of footwear intended for sports, comprising:

a first rigid shell which defines a body which is intended to receive the foot of a user and which extends in an longitudinal direction, a second rigid shell which defines an upper which is intended to receive the leg of the user and which extends substantially in an upright direction, and an articulation which connects the body and the upper, said articulation allowing rotation of the upper relative to the body in two axes of rotation which are substantially perpendicular to each other, the articulation comprising at least at least two flexible strips forming a resiliently deformable element which tends to move the item of footwear into an initial position, each flexible strips being substantially V-shaped or U-shaped so that each flexible strip comprises two branches, each branch comprising a first end and a second end, the first ends of each flexible strip being connected to each other and the second ends of each flexible strip being connected, in the case of one of the branches, to the body and, in the case of the other branch, to the upper, so that said articulation allows translation of the axes of articulation relative to the body in order to bring the axes of rotation of the articulation substantially into alignment with the axes of rotation of the foot relative to the leg of the user.

2. Item of footwear according to claim 1, characterised in that, with the item of footwear having an inner face and an outer face which extend at one side and the other of a centre plane which is defined by the longitudinal direction and the upright direction, each resiliently deformable element is positioned at the inner face or the outer face of the item of footwear, substantially level with the malleolus of the foot of the user.

3. Item of footwear according to claim 2, characterised in that each flexible strip has an inwardly curved shape in the absence of any external stress.

4. Item of footwear according to claim 2, characterised in that the articulation further comprises at least a pivot which is interposed between the body and the upper and which guides the rotation of the upper relative to the body about a transverse direction which is substantially perpendicular to the longitudinal direction and the upright direction.

5. Item of footwear according to claim 2, characterised in that the articulation comprises two resiliently deformable elements which are arranged symmetrically relative to the centre plane, one at the inner face, the other at the outer face, at both sides of the ankle of the user.

6. Item of footwear according to claim 5, characterised in that each flexible strip has an inwardly curved shape in the absence of any external stress.

7. Item of footwear according to claim 5, characterised in that the articulation further comprises at least a pivot which is interposed between the body and the upper and which guides the rotation of the upper relative to the body about a transverse direction which is substantially perpendicular to the longitudinal direction and the upright direction.

8. Item of footwear according to claim 5, characterised in that the two resiliently deformable elements have different mechanical properties.

9. Item of footwear according to claim 5, characterised in that each flexible strip has an inwardly curved shape in the absence of any external stress.

10. Item of footwear according to claim 8, characterised in that the articulation further comprises at least a pivot which is interposed between the body and the upper and which guides the rotation of the upper relative to the body about a transverse direction which is substantially perpendicular to the longitudinal direction and the upright direction.

11. Item of footwear according to claim 1, characterised in that each flexible strip has an inwardly curved shape in the absence of any external stress.

12. Item of footwear according to claim 1, characterised in that it further comprises a resiliently deformable material which is different from that of the branches and which extends between the branches of at least some of the flexible strips.

13. Item of footwear according to claim 1, characterised in that the articulation further comprises at least a pivot which is interposed between the body and the upper and which guides the rotation of the upper relative to the body about a transverse direction which is substantially perpendicular to the longitudinal direction and the upright direction.

14. Item of footwear according to claim 1, characterised in that, with the upright direction and the longitudinal direction defining a centre plane, the item of footwear further comprises stops for limiting the extent of rotation in the centre plane to a value of between 50° and 60°.

15. Item of footwear according to claim 1, characterised in that it further comprises stops for limiting the extent of rotation in the longitudinal direction to a value of between 25° and 35°.

16. Item of footwear according to claim 1, characterised in that said articulation allows translation only in the upright direction.

17. Item of footwear according to claim 1, characterised in that the two axes of articulation are substantially perpendicular to the upright direction.

18. Item of footwear according to claim 1, characterised in that the extent of translation of the axes of articulation relative to the body is between 5 millimeters and 15 millimeters.

19. Item of footwear intended for sports, comprising:

a first rigid shell which defines a body which is intended to receive the foot of a user and which extends in an longitudinal direction, a second rigid shell which defines an upper which is intended to receive the leg of the user and which extends substantially in an upright direction, and an articulation which connects the body and the upper, said articulation allowing rotation of the upper relative to the body in two axes of rotation which are substantially perpendicular to each other, the articulation comprising at least a resiliently deformable element which tends to move the item of footwear into an initial position, each resiliently deformable element comprises at least a flexible strip having an inwardly curved shape in the absence of any external stress, each resiliently deformable element comprising two flexible strips which are substantially V-shaped or U-shaped so that each flexible strip comprises two branches, each comprising a first end and a second end, the first ends of each flexible strip being connected to each other and the second ends of each flexible strip being connected, in the case of one of the branches, to the body and, in the case of the other branch, to the upper, wherein, said articulation allows translation of the axes of articulation relative to the body in order to bring the axes of rotation of the articulation substantially into alignment with the axes of rotation of the foot relative to the leg of the user.

* * * * *